United States Patent [19]

Swearingen et al.

[11] Patent Number: 5,002,459

[45] Date of Patent: Mar. 26, 1991

[54] SURGE CONTROL SYSTEM

[75] Inventors: Judson S. Swearingen, Glendora; Reza Agahi, Sepulveda, both of Calif.

[73] Assignee: Rotoflow Corporation, Gardena, Calif.

[21] Appl. No.: 225,235

[22] Filed: Jul. 28, 1988

[51] Int. Cl.[5] ..... F01D 17/06

[52] U.S. Cl. ..... 415/17; 415/1; 415/30

[58] Field of Search ..... 415/1, 11, 17, 27, 28, 415/30, 37, 39, 52.1; 60/39.29

[56] References Cited

U.S. PATENT DOCUMENTS

| | | | |
|---|---|---|---|
| 3,473,727 | 1/1968 | Eastman | 415/27 |
| 3,919,838 | 11/1975 | Armstrong et al. | 60/39.29 |
| 4,184,337 | 1/1980 | Bloch | 415/17 |
| 4,581,888 | 4/1986 | Schmitzer et al. | 60/39.29 |
| 4,586,870 | 5/1986 | Hohlweg et al. | 415/27 |
| 4,627,788 | 12/1986 | Keyes, IV et al. | 415/27 |
| 4,656,589 | 4/1987 | Albers et al. | 415/17 |
| 4,687,410 | 8/1987 | Cline et al. | 415/17 |
| 4,697,980 | 10/1987 | Keyes, IV et al. | 415/11 |
| 4,831,535 | 5/1989 | Blotenberg | 415/17 |

OTHER PUBLICATIONS

European patent #319,849, Jun. 1989.

*Primary Examiner*—John T. Kwon
*Attorney, Agent, or Firm*—Lyon & Lyon

[57] ABSTRACT

A surge control system for a compressor comprising a bypass passage controlled by a bypass valve to return flow to the compressor inlet for avoiding surge in the compressor. The bypass valve is controlled through a sensing of a compressor speed and flow. The compressor speed and the square root of the flow signal, which is proportional to the actual flow, are presented as a ratio for comparison with an empirically established constant. When the conditions of the compressor system are such that the ratio approaches the constant, the bypass valve is opened and the compressor experiences increased flow therethrough.

9 Claims, 1 Drawing Sheet

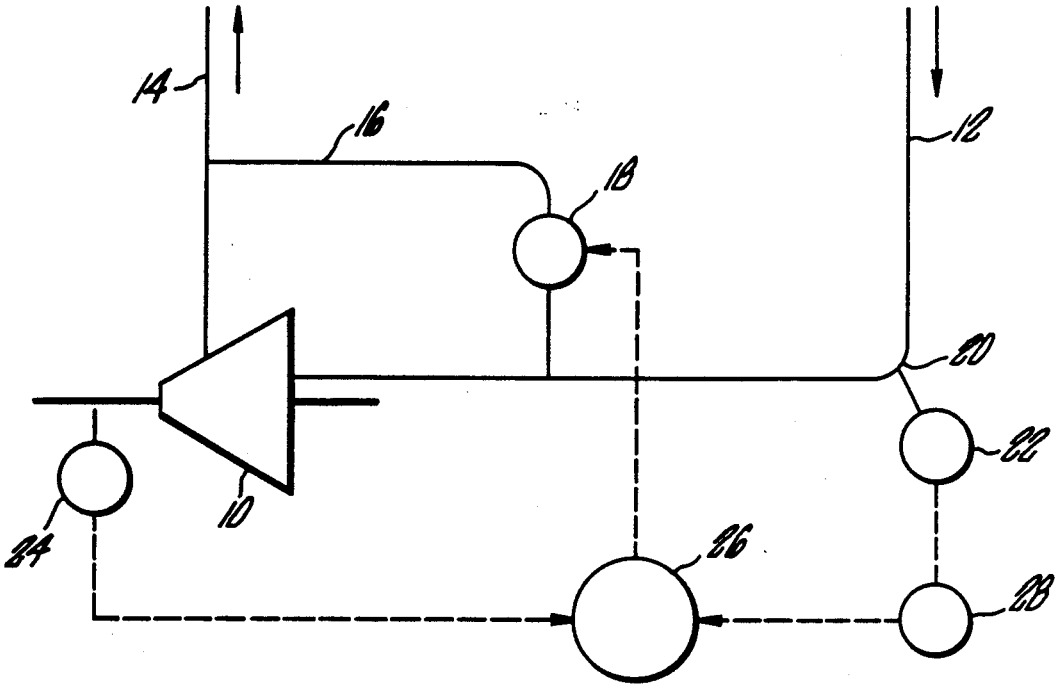
14
16
18
12
20
22
10
24
26
28

SURGE CONTROL SYSTEM

BACKGROUND OF THE INVENTION

The field of the present invention is surge control for centrifugal compressors.

Centrifugal compressors can be susceptible to the phenomenon of surging. Surging is typically found to occur at specific ranges of flow for each compressor system. The range of flow may be located experimentally and efforts undertaken to avoid that range. The surge point is also affected by the speed of the compressor. To avoid such surge, bypass systems have been used which include a flow path around the compressor which can, for example, return compressed air to the compressor inlet to increase the actual flow through the compressor to a level avoiding the surge point. Bypass valves have been used in such flow paths to control the system.

Two common methods have been employed for sensing the onset of surge and actuating a bypass valve to avoid the phenomenon. In a first system, the surge flow range for a compressor system is experimentally located. Instrumentation may then be employed to generate a signal when the compressor approaches the critical range and to operate a bypass system responsive to the onset of surge. Typically this instrumentation senses the pressure difference generated by the compressor. This pressure difference varies approximately as the square of the compressor speed. Thus, a surge onset line plotted against pressure and flow appears as a parabola. As the use of a parabolic curve is difficult, a conventional approach is to use the pressure drop across a flow meter which varies as the square of flow and, therefore, also as the square of speed. This ratio of the compressor pressure gain and the drop in pressure across the flow meter is, therefore, relatively constant regardless of flow and speed. This ratio thus becomes useful to control a surge preventing bypass valve through comparison with an empirically determined constant.

Another conventional method for controlling surge is by means of instrumentation that can sense pulsations. Characteristic pulsations can be observed which signal the onset of surge. Again, a bypass valve can be controlled to artificially change flow conditions through the compressor to avoid the critical flow range.

Compressor systems where surge becomes a concern typically have a compressor pressure gain ratio approaching two. The compressor head gain varies as the square of compressor speed. This head gain is related to the pressure rise as follows:

$$H = \frac{R\,T_{avg}\ln(P_2/P_1)}{W_m}$$

Where

| | | |
|---|---|---|
| $R$ | = | universal gas constant |
| $T_{avg}$ | = | average temperature in compressor |
| $W_m$ | = | molecular weight |
| $P_2/P_1$ | = | Pressure gain in compressor |
| $H$ | = | Head |

The value of ln ($P_2/P_1$) for small values of $P_2/P_1$ approaches ($P_2P_1$)/$P_1$, illustrated by the following table:

| $P_2/P_1$ | 1.001 | 1.1 | 1.2 | 1.5 | 2.0 | 3.0 | 10.0 |
|---|---|---|---|---|---|---|---|
| ln ($P_2/P_1$) | 0.001 | .095 | .182 | .405 | .690 | 1.099 | 2.303 |
| $\frac{\ln(P_2/P_1)}{(P_2 - P_1)/P_1}$ | .999 | .950 | .910 | .810 | .690 | .550 | .26 |

From the foregoing, it can be seen that for infinitesimal pressure rise ratios, the ratio of ($P_2$-$P_1$)/$P_1$ is equal to the logarithm of $P_2/P_1$. In other words, at low compression ratios, the conventional method based on compressor pressure rise is accurate. At the same time, the error rapidly rises with pressure ratio. At a ratio of 1.1:1 the error is 5%; at 2:1 the error is 31%.

SUMMARY OF THE INVENTION

The present invention is directed to an inexpensive and uncomplicated method and apparatus for the control of surge in a compressor system. A speed signal is employed with the square root of a flow signal which, when presented in a ratio, provide a reliable indicator of compressor condition affecting the possibility of surge. The comparison of such a ratio with an empirically determined constant provides accurate prediction of surge such that a bypass valve or the like may be activated to increase flow through the compressor.

Accordingly, it is an object of the present invention to provide improved surge control in compressor systems.

BRIEF DESCRIPTION OF THE DRAWINGS

FIG. 1 is a schematic illustration of a compressor system and surge control system associated with the compressor system.

DETAILED DESCRIPTION OF THE PREFERRED EMBODIMENT

The figure schematically illustrates a compressor 10. Inlet flow to the compressor is presented through passage 12 while outlet flow is through passage 14. A bypass line 16 is shown to run from the outlet passage 14 to the inlet passage 12. A bypass valve 18 controls the flow through the bypass 16. When open, the bypass line 16 receives higher pressure fluid from the outlet 14 which it returns to the inlet passage 12. This redirection of flow increases the amount of flow which the compressor receives as a mechanism for avoiding the flow range where surge can occur.

Associated with the inlet passage 12 is an elbow 20. Such an elbow provides a convenient mechanism for the creation of a flow sensing system. Pressure may be measured both upstream and downstream of the elbow 20 to establish the pressure drop across the elbow which varies as the square of the flow through the elbow. A meter 22 is illustrated schematically which measures the flow in this manner at the elbow 20.

A sensor 24 which may typically be a transducer associated with the compressor shaft is employed to sense the compressor speed. Both the flow signal and the speed signal are directed to a converter 26. The flow signal is first converted to a square root by converter 28 to obtain a direct proportional reading of the flow. The converter 26 receives the signals from the sensor 24 and the convertor 28 and establishes a ratio of the two. This ratio is then compared with a constant established by empirical study of the compressor system. When the conditions of the compressor system create a ratio which approaches the constant, a signal is generated to actuate the bypass valve 18 to allow flow through passage 16.

Typically, compressor systems employ a speed sensing transducer and a flow meter. Consequently, it is not unlikely that no additional sensing equipment is required for establishing a bypass system. Conventional converters may be employed in association with a valve control device for creating the appropriate control system. The ratio at which the surge control system becomes active may be adjustable through simple magnitude adjustments at any of the electrical components. For example, the speed signal may be magnified to adjust the ratio sensed by the system. Such an adjustment would result in a signal comparison with the constant that is achieved at a new operating condition of the compressor system.

Accordingly, method and apparatus for the control of surge in a compressor system is disclosed which offers accuracy at a low cost. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A method for determining surge conditions in a compressor, comprising the steps of directly sensing the speed of a compressor and generating a first signal proportional thereto;

sensing inlet flow to the compressor and generating a second signal proportional to the compressor flow;

comparing a ratio of said first and second signals to an established constant indicative of surge conditions in the compressor.

2. The method of claim 1 wherein said step of directly sensing compressor speed employs a transducer at the shaft of said compressor.

3. The method of claim 1 wherein said step of sensing compressor flow includes sensing inlet flow to the compressor by measuring a pressure drop in the flow, generating a sensor signal proportional to the pressure drop, converting the sensor signal into said second signal proportional to the square root of said sensor signal.

4. The method of claim 1 wherein said step of sensing compressor flow includes sensing inlet flow to the compressor using a flow sensing system measuring pressure drop in the flow, generating a sensor signal proportional to the pressure drop across the flow sensing system, converting the sensor signal to said second signal proportional to the square root of said sensor signal.

5. A method for determining surge conditions in a compressor, comprising the steps of directly sensing the speed of a compressor to generate a first signal proportional to the speed of the compressor;

sensing inlet flow to the compressor using a flow sensing system to measure a pressure drop in the flow, to generate a sensor signal proportional to the pressure drop and to convert the sensor signal to a second signal proportional to the compressor flow and to the square root of said sensor signal;

comparing a ratio of said first and second signals to an established constant indicative of surge conditions in the compressor.

6. A method for controlling compressor surge, comprising the steps of directly sensing the speed of a compressor and generating a first signal proportional thereto;

sensing inlet flow to the compressor and generating a second signal proportional to pressure change across a flow sensing system;

receiving said second signal and generating a third signal proportional to the square root of said second signal;

comparing a ratio of said first and third signals to a constant indicative of surge conditions in the compressor and generating a fourth signal indicative of surge onset;

inducing compressor bypass flow to alter compressor flow rates responsive to said fourth signal.

7. A surge control system for a compressor, comprising a sensor measuring compressor speed;

a flow meter measuring inlet flow to the compressor;

a first means coupled with said flow meter for generating the square root of the signal of said flow meter;

a second means coupled with said sensor and said first means for generating a ratio of the signal of said sensor and the signal of said first means, comparing the ratio with an established constant and selectively generating a signal responsive thereto;

a bypass valve coupled with said third means;

a flow path controlled by said bypass valve and coupled and parallel with the compressor.

8. The surge control system of claim 7 wherein said sensor is a transducer sensing speed of the shaft of the compressor.

9. The surge control system of claim 7 wherein said first means is a signal converter.

* * * * *